US006422821B1

(12) United States Patent
Lee et al.

(10) Patent No.: US 6,422,821 B1
(45) Date of Patent: Jul. 23, 2002

(54) METHOD AND APPARATUS FOR REDUCING TURBINE BLADE TIP TEMPERATURES

(75) Inventors: Ching-Pang Lee; Chander Prakash, both of Cincinnati; Monty Lee Shelton, Loveland; John Howard Starkweather, Cincinnati; Hardev Singh, Mason; Gerard Anthony Rinck, Cincinnati, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/756,902

(22) Filed: Jan. 9, 2001

(51) Int. Cl.[7] ..... F01D 5/18

(52) U.S. Cl. ..... 416/224; 416/228; 416/236 R; 416/92; 416/97 R

(58) Field of Search ..... 416/228, 236 R, 416/92, 97 R, 224, 173.4, 96 R; 415/115, 116

(56) References Cited

U.S. PATENT DOCUMENTS

| | | | | |
|---|---|---|---|---|
| 5,261,789 A | | 11/1993 | Butts et al. | 416/96 R |
| 5,503,527 A | | 4/1996 | Lee et al. | 416/91 |
| 6,059,530 A | * | 5/2000 | Lee | 416/96 A |

* cited by examiner

*Primary Examiner*—Edward K. Look
*Assistant Examiner*—Kimya N. McCoy
(74) *Attorney, Agent, or Firm*—William Scott Andes; Armstrong Teasdale LLP

(57) ABSTRACT

A rotor blade for a gas turbine engine including a tip region that facilitates reducing operating temperatures of the rotor blade is described. The tip region includes a first tip wall and a second tip wall extending radially outward from a tip plate of an airfoil. The tip walls extend from adjacent a leading edge of the airfoil to connect at a trailing edge of the airfoil. A notch is defined between the first and second tip walls at the airfoil leading edge. At least a portion of the second tip wall is recessed to define a tip shelf.

20 Claims, 4 Drawing Sheets

METHOD AND APPARATUS FOR REDUCING TURBINE BLADE TIP TEMPERATURES

BACKGROUND OF THE INVENTION

This application relates generally to gas turbine engine rotor blades and, more particularly, to methods and apparatus for reducing rotor blade tip temperatures.

Gas turbine engine rotor blades typically include airfoils having leading and trailing edges, a pressure side, and a suction side. The pressure and suction sides connect at the airfoil leading and trailing edges, and span radially between the airfoil root and the tip. To facilitate reducing combustion gas leakage between the airfoil tips and stationary stator components, the airfoils include a tip region that extends radially outward from the airfoil tip.

The airfoil tip regions include a first tip wall extending from the airfoil leading edge to the trailing edge, and a second tip wall also extending from the airfoil leading edge to connect with the first tip wall at the airfoil trailing edge. The tip region prevents damage to the airfoil if the rotor blade rubs against the stator components.

During operation, combustion gases impacting the rotating rotor blades transfer heat into the blade airfoils and tip regions. Over time, continued operation in higher temperatures may cause the airfoil tip regions to thermally fatigue. To facilitate reducing operating temperatures of the airfoil tip regions, at least some known rotor blades include slots within the tip walls to permit combustion gases at a lower temperature to flow through the tip regions.

To facilitate minimizing thermal fatigue to the rotor blade tips, at least some known rotor blades include a shelf adjacent the tip region to facilitate reducing operating temperatures of the tip regions. The shelf is defined within the pressure side of the airfoil and disrupt combustion gas flow as the rotor blades rotate, thus enabling a film layer of cooling air to form against the pressure side of the airfoil. The film layer insulates the blade from the higher temperature combustion gases.

BRIEF SUMMARY OF THE INVENTION

In an exemplary embodiment, a rotor blade for a gas turbine engine includes a tip region that facilitates reducing operating temperatures of the rotor blade, without sacrificing aerodynamic efficiency of the turbine engine. The tip region includes a first tip wall and a second tip wall that extend radially outward from an airfoil tip plate. The first tip wall extends from adjacent a leading edge of the airfoil to a trailing edge of the airfoil. The second tip wall also extends from adjacent the airfoil leading edge and connects with the first tip wall at the airfoil trailing edge to define an open-top tip cavity. At least a portion of the second tip wall is recessed to define a tip shelf. A notch extends from the tip plate and is defined between the first and second tip walls at the airfoil leading edge. The notch is in flow communication with the tip cavity.

During operation, as the rotor blades rotate, combustion gases at a higher temperature near each rotor blade leading edge migrate to the airfoil tip region. Because the tip walls extend from the airfoil, a tight clearance is defined between the rotor blade and stationary structural components that facilitates reducing combustion gas leakage therethrough. If rubbing occurs between the stationary structural components and the rotor blades, the tip walls contact the components and the airfoil remains intact. As the rotor blade rotates, combustion gases at lower temperatures near the leading edge flow through the notch and induce cooler gas temperatures into the tip cavity. The combustion gases on a pressure side of the rotor blade also flow over the tip region shelf and mix with film cooling air. As a result, the notch and shelf facilitate reducing operating temperatures of the rotor blade within the tip region, but without consuming additional cooling air, thus improving turbine efficiency.

DETAILED DESCRIPTION OF THE INVENTION

Figure 1:
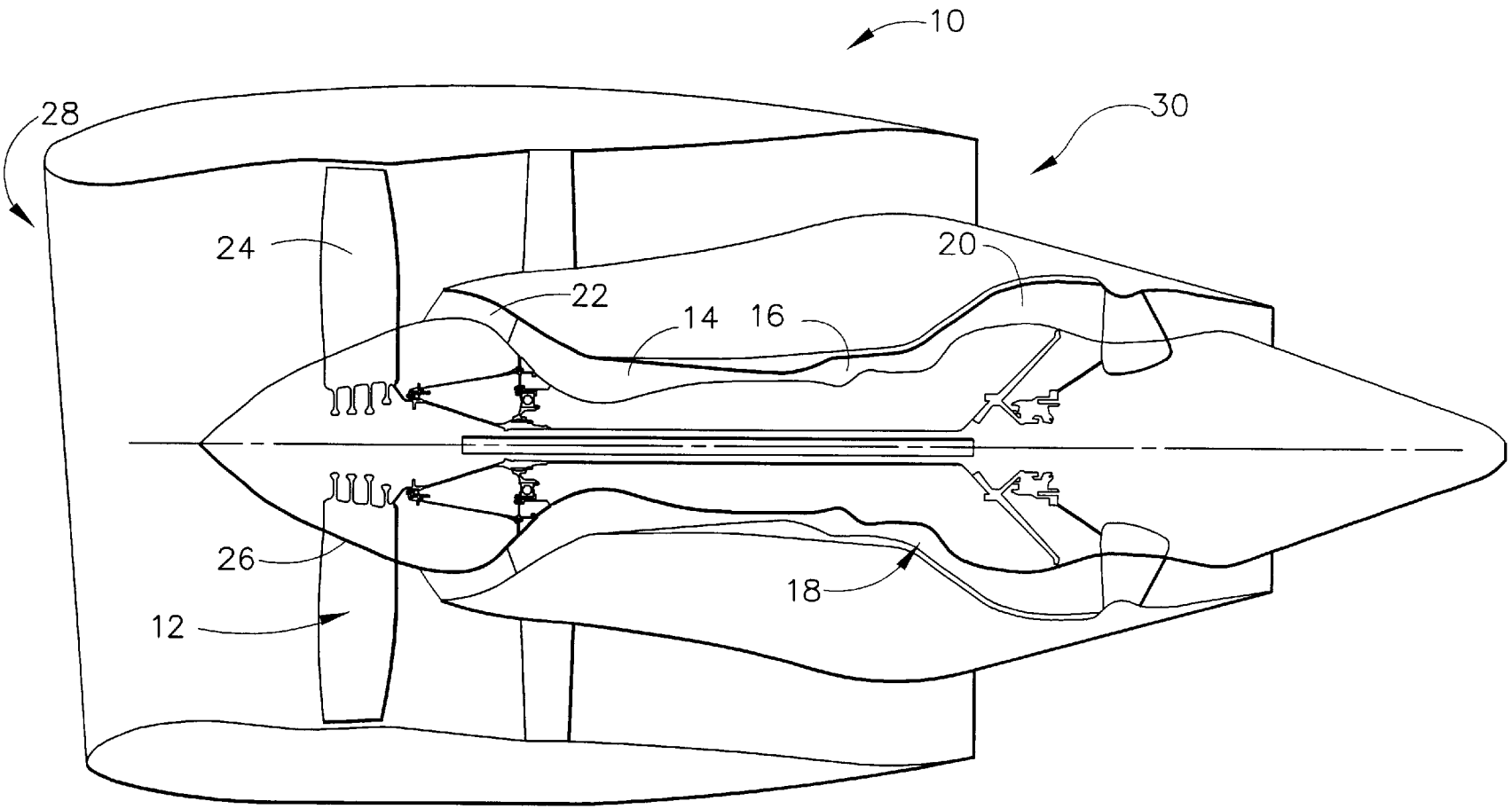
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30.

In operation, air flows through fan assembly 12 and compressed air is supplied to high pressure compressor 14. The highly compressed air is delivered to combustor 16. Airflow (not shown in FIG. 1) from combustor 16 drives turbines 18 and 20, and turbine 20 drives fan assembly 12.

Figure 2:
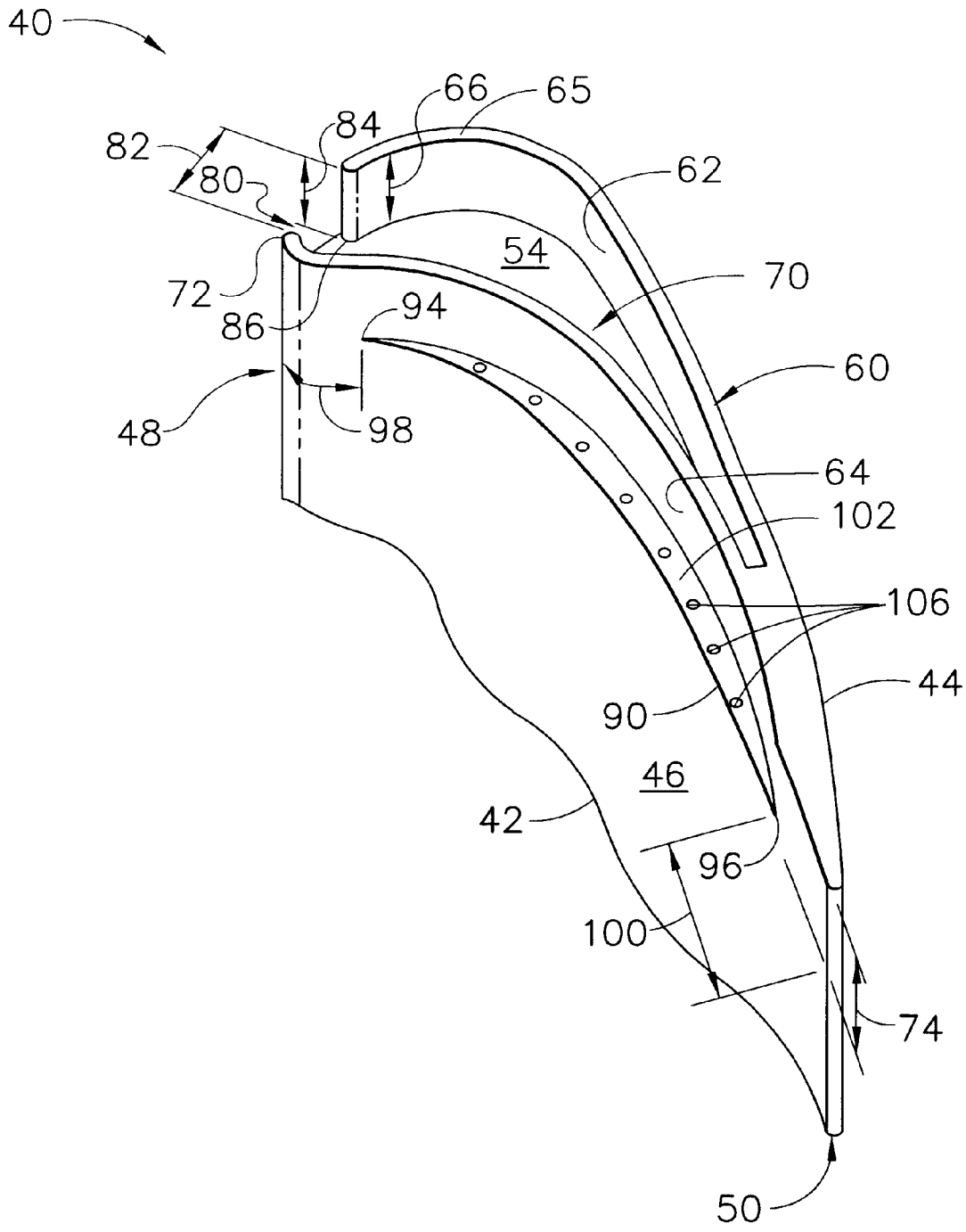
FIG. 2 is a partial perspective view of a rotor blade that may be used with the gas turbine engine shown in FIG. 1.

FIG. 2 is a partial perspective view of a rotor blade 40 that may be used with a gas turbine engine, such as gas turbine engine 10 (shown in FIG. 1). In one embodiment, a plurality of rotor blades 40 form a high pressure turbine rotor blade stage (not shown) of gas turbine engine 10. Each rotor blade 40 includes a hollow airfoil 42 and an integral dovetail (not shown) used for mounting airfoil 42 to a rotor disk (not shown) in a known manner.

Airfoil 42 includes a first sidewall 44 and a second sidewall 46. First sidewall 44 is convex and defines a suction side of airfoil 42, and second sidewall 46 is concave and defines a pressure side of airfoil 42. Sidewalls 44 and 46 are joined at a leading edge 48 and at an axially-spaced trailing edge 50 of airfoil 42 that is downstream from leading edge 48.

First and second sidewalls 44 and 46, respectively, extend longitudinally or radially outward to span from a blade root (not shown) positioned adjacent the dovetail to a tip plate 54 which defines a radially outer boundary of an internal cooling chamber (not shown). The cooling chamber is defined within airfoil 42 between sidewalls 44 and 46. Internal cooling of airfoils 42 is known in the art. In one embodiment, the cooling chamber includes a serpentine passage cooled with compressor bleed air. In another embodiment, sidewalls 44 and 46 include a plurality of film cooling openings (not shown), extending therethrough to facilitate additional cooling of the cooling chamber. In yet another embodiment, airfoil 42 includes a plurality of trailing edge openings (not shown) used to discharge cooling air from the cooling chamber.

A tip region 60 of airfoil 42 is sometimes known as a squealer tip, and includes a first tip wall 62 and a second tip wall 64 formed integrally with airfoil 42. First tip wall 62 extends from adjacent airfoil leading edge 48 along airfoil first sidewall 44 to airfoil trailing edge 50. More specifically, first tip wall 62 extends from tip plate 54 to an outer edge 65 for a height 66. First tip wall height 66 is substantially constant along first tip wall 62.

Second tip wall 64 extends from adjacent airfoil leading edge 48 along second sidewall 46 to connect with first tip wall 62 at airfoil trailing edge 50. More specifically, second tip wall 64 is laterally spaced from first tip wall 62 such that an open-top tip cavity 70 is defined with tip walls 62 and 64, and tip plate 54. Second tip wall 64 also extends radially outward from tip plate 54 to an outer edge 72 for a height 74. In the exemplary embodiment, second tip wall height 74 is equal first tip wall height 66. Alternatively, second tip wall height 74 is not equal first tip wall height 66.

A notch 80 is defined between first tip wall 62 and second tip wall 64 along airfoil leading edge 48. More specifically, notch 80 has a width 82 extending between first and second tip walls 62 and 64, and a height 84 measured between a bottom 86 of notch 80 defined by tip plate 54, and first and second tip wall outer edges 65 and 72, respectively.

In an alternative embodiment, notch 80 does not extend from tip plate 54, but instead extends from first and second tip wall outer edges 65 and 72, respectively, towards tip plate 54 for a distance (not shown) that is less than notch height 84, and accordingly, notch bottom 86 is a distance (not shown) from tip plate 54. In a further alternative embodiment, second tip wall 64 is not connected to first tip wall 62 at airfoil trailing edge 50, and an opening (not shown) is defined between first tip wall 62 and second tip wall 64 at airfoil trailing edge 50.

Notch 80 is in flow communication with open-top tip cavity 70 and permits combustion gas at a lower temperature to enter cavity 70 for lower heating purposes. In one embodiment, notch 80 also includes a guidewall (not shown in FIG. 2) used to channel flow entering open-top tip cavity 70 towards second tip wall 64. More specifically, the guidewall extends from notch 80 towards airfoil trailing edge 50.

Second tip wall 64 is recessed at least in part from airfoil second sidewall 46. More specifically, second tip wall 64 is recessed from airfoil second sidewall 46 toward first tip wall 62 to define a radially outwardly facing first tip shelf 90 which extends generally between airfoil leading and trailing edges 48 and 50. More specifically, shelf 90 includes a front edge 94 and an aft edge 96. Front edge 94 and aft edge 96 each taper to be flush with second sidewall 46. Shelf front edge 94 is a distance 98 downstream of airfoil leading edge 48, and shelf aft edge 96 is a distance 100 upstream from airfoil trailing edge 50.

Recessed second tip wall 64 and shelf 90 define a generally L-shaped trough 102 therebetween. In the exemplary embodiment, tip plate 54 is generally imperforate and only includes a plurality of openings 106 extending through tip plate 54 at tip shelf 90. Openings 106 are spaced axially along shelf 90 and are in flow communication between trough 102 and the internal airfoil cooling chamber. In one embodiment, tip region 60 and airfoil 42 are coated with a thermal barrier coating.

During operation, squealer tip walls 62 and 64 are positioned in close proximity with a conventional stationary stator shroud (not shown), and define a tight clearance (not shown) therebetween that facilitates reducing combustion gas leakage therethrough. Tip walls 62 and 64 extend radially outward from airfoil 42. Accordingly, if rubbing occurs between rotor blades 40 and the stator shroud, only tip walls 62 and 64 contact the shroud and airfoil 42 remains intact.

Because combustion gases assume a parabolic profile flowing through a turbine flowpath, combustion gases near turbine blade tip region leading edge 48 are at a lower temperature than gases near turbine blade tip region trailing edge 50. As cooler combustion gases flow into notch 80, a heat load of tip region 60 is reduced. More specifically, combustion gases flowing into notch 80 are at a higher pressure and reduced temperature than gases leaking from rotor blade pressure side 46 through the tip clearance to rotor blade suction side 44. As a result, notch 80 facilitates reducing an operating temperatures within tip region 60.

Furthermore, as combustion gases flow past airfoil first tip shelf 90, trough 102 provides a discontinuity in airfoil pressure side 46 which causes the combustion gases to separate from airfoil second sidewall 46, thus facilitating a decrease in heat transfer thereof Additionally, trough 102 provides a region for cooling air to accumulate and form a film against sidewall 46. First tip shelf openings 106 discharge cooling air from the airfoil internal cooling chamber to form a film cooling layer on tip region 60. Because of blade rotation, combustion gases outside rotor blade 40 at leading edge 48 near a blade pitch line (not shown) will migrate in a radial flow toward airfoil tip region 60 near trailing edge 50 along second sidewall 46 such that leading edge tip operating temperatures are lower than trailing edge tip operating temperatures. First tip shelf 90 functions as a backward facing step in the migrated radial flow and provides a shield for the film of cooling air accumulated against sidewall 46. As a result, shelf 90 facilitates improving cooling effectiveness of the film to lower operating temperatures of sidewall 46.

Figure 3:
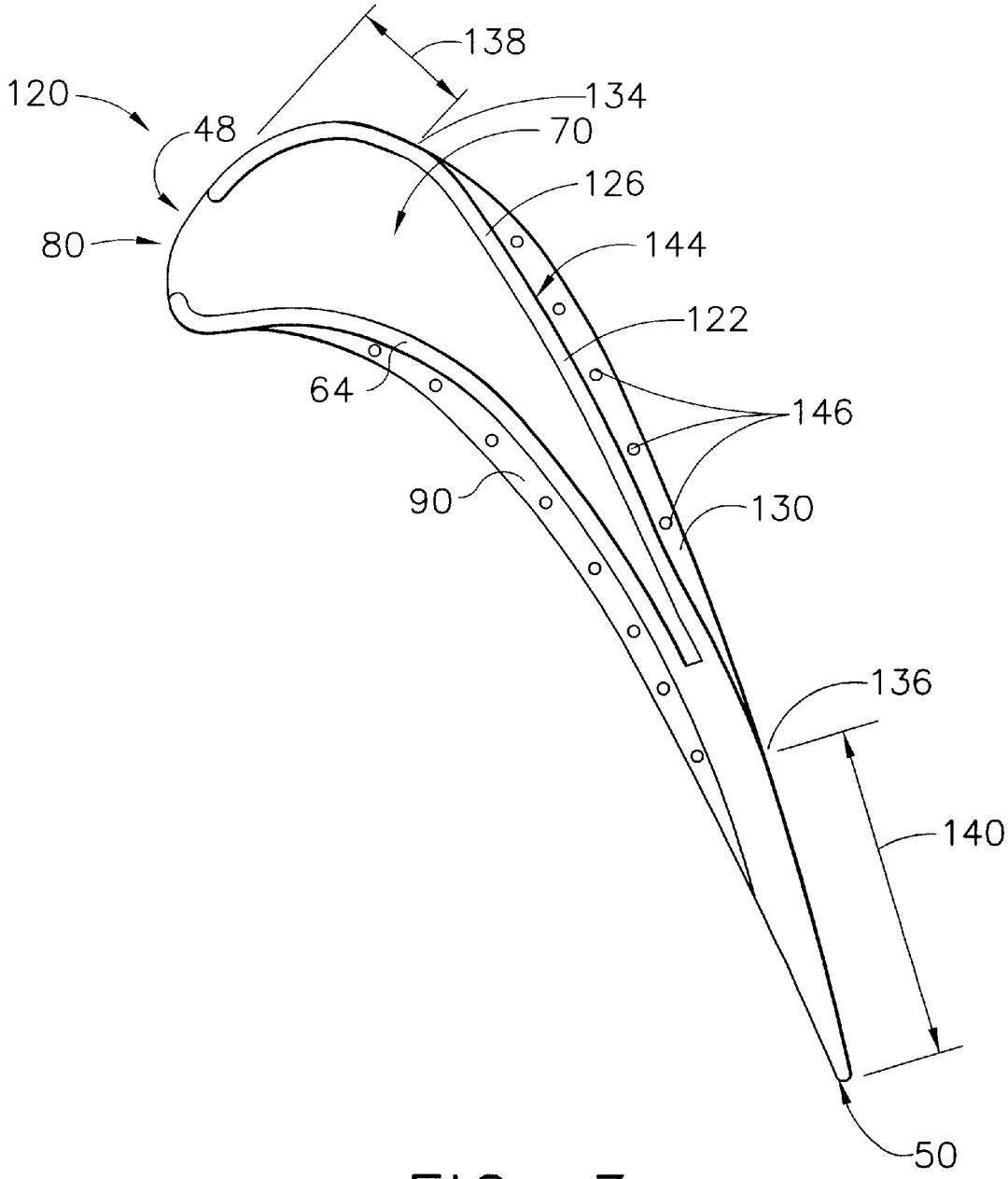
FIG. 3 is a cross-sectional view of an alternative embodiment of the rotor blade shown in FIG. 2.

FIG. 3 is a cross-sectional view of an alternative embodiment of a rotor blade 120 that may be used with a gas turbine engine, such as gas turbine engine 10 (shown in FIG. 1). Rotor blade 120 is substantially similar to rotor blade 40 shown in FIG. 2, and components in rotor blade 120 that are identical to components of rotor blade 40 are identified in FIG. 3 using the same reference numerals used in FIG. 2. Accordingly, rotor blade 120 includes airfoil 42 (shown in FIG. 2), sidewalls 44 and 46 (shown in FIG. 2) extending between leading and trailing edges 48 and 50, respectively, and notch 80. Furthermore, rotor blade 120 includes second tip wall 64 and first tip shelf 90. Additionally, rotor blade 120 includes a first tip wall 122. Notch 80 is defined between first and second tip walls 122 and 64, respectively.

First tip wall 122 extends from adjacent airfoil leading edge 48 along first sidewall 44 to connect with second tip wall 64 at airfoil trailing edge 50. More specifically, first tip wall 122 is laterally spaced from second tip wall 64 to define open-top tip cavity 70. First tip wall 122 also extends a height (not shown) radially outward from tip plate 54 to an outer edge 126. In the exemplary embodiment, the first tip wall height is equal second tip wall height 74. Alternatively, the first tip wall height is not equal second tip wall height 74.

First tip wall 122 is recessed at least in part from airfoil first sidewall 44. More specifically, first tip wall 122 is recessed from airfoil first sidewall 44 toward second tip wall 64 to define a radially outwardly facing second tip shelf 130 which extends generally between airfoil leading and trailing edges 48 and 50. More specifically, shelf 130 includes a front edge 134 and an aft edge 136. Front edge 134 and aft edge 136 each taper to be flush with first sidewall 44. Shelf front edge 134 is a distance 138 downstream of airfoil leading edge 48, and shelf aft edge 136 is a distance 140 upstream from airfoil trailing edge 50.

Recessed first tip wall 122 and second tip shelf 130 define therebetween a generally L-shaped trough 144. In the exemplary embodiment, tip plate 54 is generally imperforate and includes plurality of openings 106 extending through tip plate 54 at first tip shelf 90, and a plurality of openings 146 extending through tip plate 54 at second tip shelf 130. Openings 146 are spaced axially along second tip shelf 130 and are in flow communication between trough 144 and the internal airfoil cooling chamber. In one embodiment, tip region 62 and airfoil 42 are coated with a thermal barrier coating.

Second tip wall 202 extends from adjacent airfoil leading edge 48 along airfoil first sidewall 46 to airfoil trailing edge 50. More specifically, second tip wall 202 extends from tip plate 54 to an outer edge 204 for a height (not shown). The second tip wall height is substantially constant along second tip wall 202. Second tip wall 202 is laterally spaced from first tip wall 62 to define open-top tip cavity 70. In the exemplary embodiment, the second tip wall height is equal first tip wall height 66. Alternatively, the second tip wall height is not equal first tip wall height 66.

Furthermore, as rotor blades 40 rotate and combustion gases flow past airfoil tip shelves 90 and 130, troughs 102 and 144, respectively provide a discontinuity in airfoil pressure side 46 and airfoil suction side 44, respectively, which causes the combustion gases to separate from airfoil sidewalls 46 and 44, respectively, thus facilitating a decrease in heat transfer thereof Trough 144 functions similarly with trough 102 to facilitate film cooling circulation..

Figure 4:
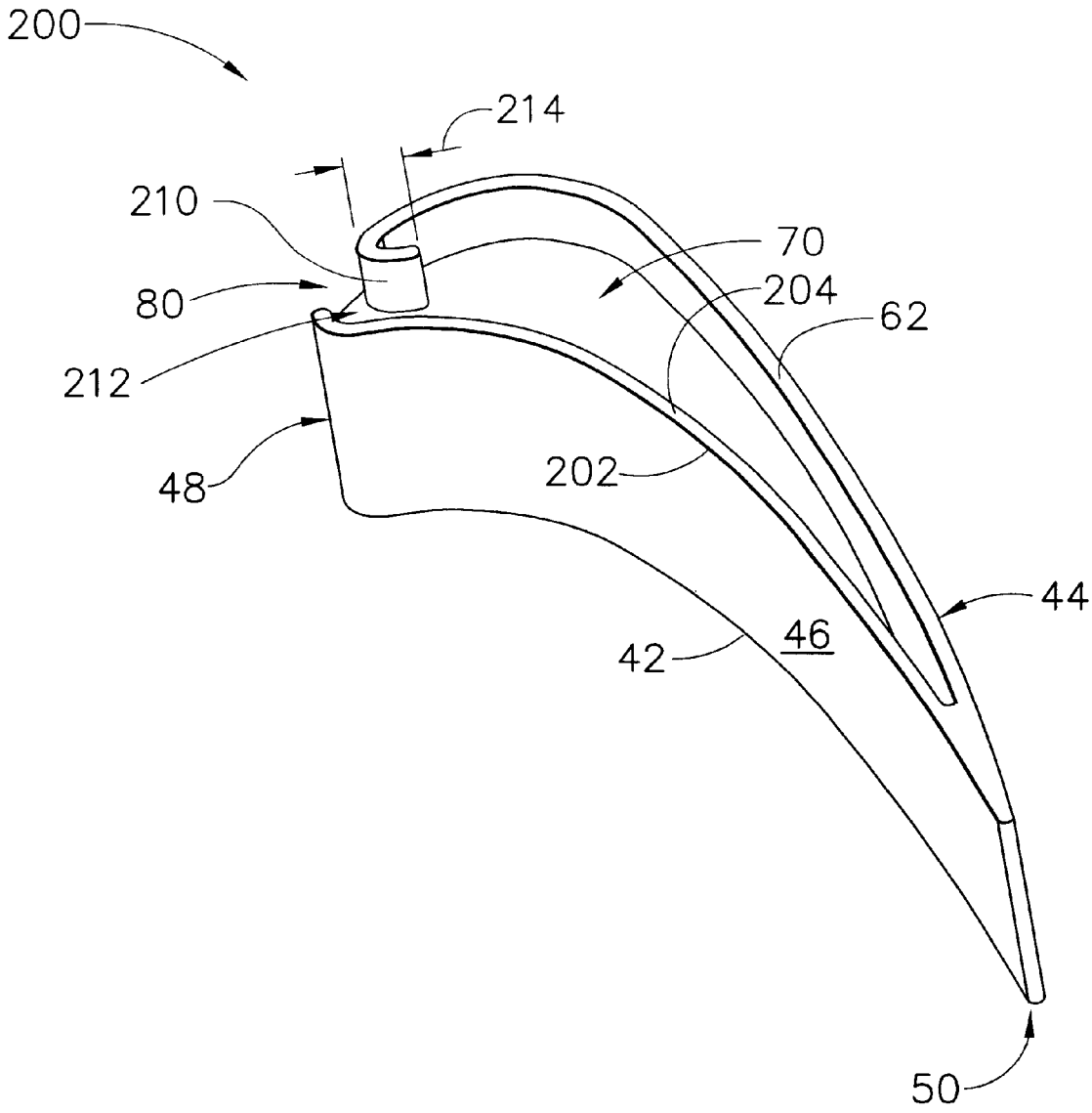
FIG. 4 is a partial perspective view of another alternative embodiment of a rotor blade that may be used with the gas turbine engine shown in FIG. 1.

FIG. 4 is a partial perspective view of an alternative embodiment of a rotor blade 200 that may be used with a gas turbine engine, such as gas turbine engine 10 (shown in FIG. 1). Rotor blade 200 is substantially similar to rotor blade 40 shown in FIG. 2, and components in rotor blade 200 that are identical to components of rotor blade 40 are identified in FIG. 4 using the same reference numerals used in FIG. 2. Accordingly, rotor blade 200 includes airfoil 42, sidewalls 44 and 46 extending between leading and trailing edges 48 and 50, respectively, and notch 80. Furthermore, rotor blade 200 includes first tip wall 62, notch 80, and a second tip wall 202. Notch 80 is defined between first and second tip walls 62 and 202, respectively.

Second tip wall 202 extends from adjacent airfoil leading edge 48 along airfoil first sidewall 44 to airfoil trailing edge 50. More specifically, second tip wall 202 extends from tip plate 54 to an outer edge 204 for a height (not shown). The second tip wall height is substantially constant along second tip wall 202. Second tip wall 202 is laterally spaced from first tip wall 62 to define open-top tip cavity 70 In the exemplary embodiment, the second tip wall height is equal first tip wall height 66. Alternatively, the second tip wall height is not equal first tip wall height 66.

Notch 80 includes a guidewall 210 extending from first tip wall 62 towards airfoil trailing edge. More specifically, guidewall 210 curves to extend from first tip wall 62 to define a curved entrance 212 for notch 80. Guidewall 210 has a length 214 that is selected to channel airflow entering open-top tip cavity 70 towards second tip wall 202.

The above-described rotor blade is cost-effective and highly reliable. The rotor blade includes a leading edge notch defined between leading edges of first and second tip walls. The tip walls connect at a trailing edge of the rotor blade and define a tip cavity. In the exemplary embodiment, one of the tip walls is recessed to define a tip shelf. During operation, as the rotor blade rotates, the tip walls prevent the rotor blade from rubbing against stationary structural members. As combustion gases flow past the rotor blade, the rotor blade notch facilitates lowering heating of the tip cavity without increasing cooling air requirements and sacrificing aerodynamic efficiency of the rotor blade. Furthermore, the tip shelf disrupts combustion gases flowing past the airfoil to facilitate a cooling layer being formed against the shelf As a result, cooler operating temperatures within the rotor blade facilitate extending a useful life of the rotor blades in a cost-effective and reliable manner.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine to facilitate reducing operating temperatures of a tip portion of the rotor blade, the rotor blade including a leading edge, a trailing edge, a first sidewall, and a second sidewall, the first and second sidewalls connected axially at the leading and trailing edges, and extending radially between a rotor blade root to a rotor blade tip plate, said method comprising the steps of:

forming a first tip wall extending from the rotor blade tip plate along the first sidewall; and forming a second tip wall extending from the rotor blade tip plate along the second sidewall such that the second tip wall connects with the first tip wall at the rotor blade trailing edge, and such that a notch is defined between the first and second tip walls along the rotor blade leading edge.

2. A method in accordance with claim 1 further comprising the step of forming a guide wall extending from the rotor blade notch afterward towards the rotor blade trailing edge such that flow entering the notch is directed with the guide wall towards the first sidewall.

3. A method in accordance with claim 1 wherein said step of forming a first tip wall further comprises the step of recessing at least a portion of the first tip wall with respect to the rotor blade first sidewall such that a first tip shelf is defined.

4. A method in accordance with claim 3 wherein said step of forming a second tip wall further comprises the step of recessing at least a portion of the second tip wall with respect to the rotor blade second sidewall such that a second tip shelf is defined.

5. A method in accordance with claim 1 wherein said step of forming a second tip wall further comprises the step of forming the second tip wall such that a notch extends from the tip plate and is defined between the first and second tip walls.

6. An airfoil for a gas turbine engine, said airfoil comprising:

a leading edge;

a trailing edge;

a tip plate;

a first sidewall extending in radial span between an airfoil root and said tip plate;

a second sidewall connected to said first sidewall at said leading edge and said trailing edge, said second sidewall extending in radial span between the airfoil root and said tip plate;

a first tip wall extending radially outward from said tip plate along said first sidewall;

a second tip wall extending radially outward from said tip plate along said second sidewall, said first tip wall connected to said second tip wall at said trailing edge; and a notch extending between said first tip wall and said second tip wall along said airfoil leading edge.

7. An airfoil in accordance with claim 6 wherein said notch comprises a guide wall extending from said notch towards said airfoil trailing edge.

8. An airfoil in accordance with claim 7 wherein said guide wall configured to channel flow entering said notch towards said first tip wall.

9. An airfoil in accordance with claim 6 wherein said first tip wall is recessed at least partially from said first sidewall to define a first tip shelf.

10. An airfoil in accordance with claim 9 wherein said second tip wall is recessed at least partially from said second sidewall to define a second tip shelf.

11. An airfoil in accordance with claim 6 wherein said first tip wall and said second tip wall are substantially equal in height.

12. An airfoil in accordance with claim 6 wherein said first tip wall extends a first distance from said tip plate, said second tip wall extends a second distance from said tip plate.

13. An airfoil in accordance with claim 12 wherein said notch extends from said tip plate at least one of said first distance or said second distance.

14. A gas turbine engine comprising a plurality of rotor blades, each said rotor blade comprising an airfoil comprising a leading edge, a trailing edge, a first sidewall, a second sidewall, a first tip wall, a second tip wall, and a notch, said airfoil first and second sidewalls connected axially at said leading and trailing edges, said first and second sidewalls extending radially from a blade root to said tip plate, said first tip wall extending radially outward from said tip plate along said first sidewall, said second tip wall extending radially outward from said tip plate along said second sidewall, and connected to said first tip wall at said trailing edge, said notch along said airfoil leading edge between said first tip wall and said second tip wall, said notch extending from said tip plate.

15. A gas turbine engine in accordance with claim 14 wherein said rotor blade airfoil first sidewall is concave, said rotor blade airfoil second sidewall is convex.

16. A gas turbine engine in accordance with claim 15 wherein said rotor blade airfoil notch comprises a guide wall extending from said notch towards said rotor blade trailing edge, said guide wall configured to channel flow entering said notch towards said first tip wall.

17. A gas turbine engine in accordance with claim 15 wherein said rotor blade first tip wall at least partially recessed with respect to said rotor blade first sidewall to define a first tip shelf.

18. A gas turbine engine in accordance with claim 17 wherein said rotor blade second tip wall at least partially recessed with respect to said rotor blade second sidewall to define a second tip shelf.

19. A gas turbine engine in accordance with claim 15 wherein said rotor blade notch extends radially outward from said rotor blade tip plate.

20. A gas turbine engine in accordance with claim 15 wherein said rotor blade first tip wall and said rotor blade second tip wall have approximately equal heights.

* * * * *

UNITED STATES PATENT AND TRADEMARK OFFICE

CERTIFICATE OF CORRECTION

PATENT NO. : 6,422,821 B1
DATED : July 23, 2002
INVENTOR(S) : Ching-Pang Lee et al.

It is certified that error appears in the above-identified patent and that said Letters Patent is hereby corrected as shown below:

Column 6,
Line 32, delete “afterward towards” insert therefor -- aftward towards --.

Signed and Sealed this

Twenty-fifth Day of May, 2004

JON W. DUDAS
*Acting Director of the United States Patent and Trademark Office*